US006129573A

United States Patent [19]

Juntwait et al.

[11] Patent Number: 6,129,573

[45] Date of Patent: Oct. 10, 2000

[54] ZIF FFC CONNECTOR HAVING A STRAIN RELIEF

[75] Inventors: Eric Juntwait, Irvin, Calif.; David Roque, Boiling Spring, S.C.

[73] Assignee: Hon Hai Precision Ind. Co., Ltd., Taipei Hsien, Taiwan

[21] Appl. No.: 09/195,747

[22] Filed: Nov. 18, 1998

[51] Int. Cl.[7] ..... H01R 13/62

[52] U.S. Cl. ..... 439/329; 439/260; 439/495

[58] Field of Search ..... 439/260, 495, 439/67, 77, 329, 492, 493, 494, 496, 497, 498

[56] References Cited

U.S. PATENT DOCUMENTS

| | | | |
|---|---|---|---|
| 4,640,562 | 2/1987 | Shoemaker | 339/17 F |
| 4,734,053 | 3/1988 | Imai | 439/329 |
| 4,770,645 | 9/1988 | Antes | 439/329 |
| 4,842,538 | 6/1989 | Noschese | 439/260 |
| 5,474,468 | 12/1995 | Chishima et al. | 439/495 |
| 5,542,855 | 8/1996 | Asai | 439/260 |
| 5,752,851 | 5/1998 | Zaderej et al. | 439/493 |
| 5,934,932 | 8/1999 | Ito | 439/495 |

*Primary Examiner*—Gary F. Paumen
*Assistant Examiner*—Alexander Gilman
*Attorney, Agent, or Firm*—Wei Te Chung

[57] ABSTRACT

An FFC connector having a strain relief comprises an elongate dielectric housing having front and rear faces. The front face defines a lengthwise slot for receiving a flat flexible cable therein. The housing defines a plurality of passageways in communication with the slot. Each passageway receives a terminal therein for electrical connection with an inserted flat flexible cable. The strain relief is assembled to the housing for attaching a portion of the flat flexible cable to the housing thereby limiting any motion between cable conductors of the flat flexible connector and contacts of the terminals.

7 Claims, 5 Drawing Sheets

ZIF FFC CONNECTOR HAVING A STRAIN RELIEF

FIELD OF THE INVENTION

The present invention relates to a connector, and more particularly to a zero-insertion-force flat flexible cable connector having a strain relief.

DESCRIPTION OF PRIOR ART

Flat Flexible Cables or FFCs are used in many electronic applications to reduce overall size and provide a flexible interconnect between two printed circuit boards. An FFC can be connected directly to a PCB by soldering or by using an FFC connector. One problem, which exists in using FFC connectors, is that there is not very good method to strain relief the cable and the connector. Any type of motion or vibration can cause either fretting corrosion at the connector/cable interface or in some cases, the FFC may completely disengage from the connector.

Connection between a typical FFC connector and an FFC is accomplished by inserting the FFC into a receiving slot defined within a housing of the FFC connector whereby terminals of the connector project therein. In order to reduce a resisting force resulting from deflection of the terminals from their original positions during insertion of the FFC, a ZIF FFC connector is introduced. U.S. Pat. Nos. 4,477,137 issued to Ayer on October 1984, 4,640,562 issued to Shoemaker on February 1987, 4,863,395 issued to Babuka et al. on September 1989, 5,213,534 issued to Garnder et al. on May 1993, 5,240,430 issued to Soes on August 1993, and 5,542,855 issued to Asai on August 1996 describe pertinent structures.

According to Asai's patent, a contact 48*a* of a tongue piece 48 is located away from an insertion aperture 40 when an FFC 25 is inserted. After the FFC 25 is seated, a pressure plate 36 is inserted into a pressure plate insertion aperture 46 whereby a finger piece nub 54*a* of a finger piece 54 is pushed laterally such that the contact 48*a* of the tongue piece 48 is moved to electrically connect with the FFC 25. The problem with Asai's patent is that the path of signal transmission is too long resulting in signal attenuation and lengthy flying time. Not only will a sigmoid contact member 34 have a complicated shape, but the configuration of the passageway defined within a housing will also be complicated.

SUMMARY OF THE INVENTION

An objective of this invention is to provide a FFC connector having a strain relief for ensuring the flat flexible cable will not disengage during use and significantly limit any motion between cable conductors of the flat flexible cable and contacts of terminals.

Another objective of this invention is to provide an FFC connector having an actuator which pushes contact portions of terminals away from an insertion path of the FFC thereby facilitating a zero insertion force.

In order to achieve the objectives set forth, an FFC connector having a strain relief in accordance with the present invention, comprises an elongate dielectric housing having front and rear faces. The front face defines a lengthwise slot for receiving a flat flexible cable therein. The housing defines a plurality of passageways which communicate with the elongate slot. Each passageway receives a terminal therein for electrical connection with an inserted flat flexible cable. The strain relief is assembled to the housing for attaching a portion of the flat flexible cable to the housing thereby limiting any motion between cable conductors of the flat flexible connector and contacts of the terminals.

These and additional objectives, features, and advantages of the present invention will become apparent after reading the following detailed description of the preferred embodiment of the invention taken in conjunction with the appended drawings.

DETAILED DESCRIPTION OF PREFERRED EMBODIMENTS

Figure 1:
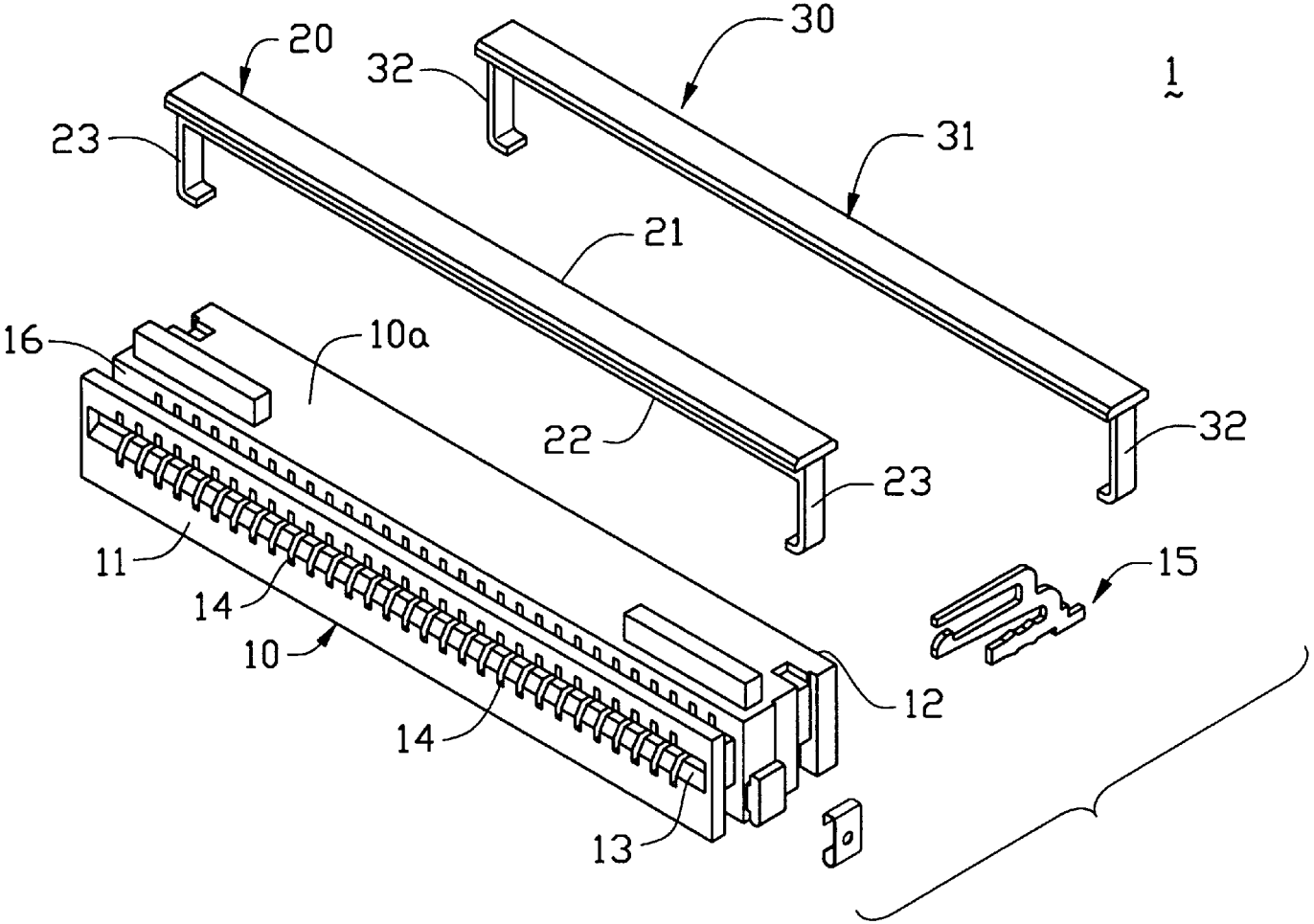
FIG. 1 is an exploded view of a FCC connector in accordance with the present invention.
Figure 2:
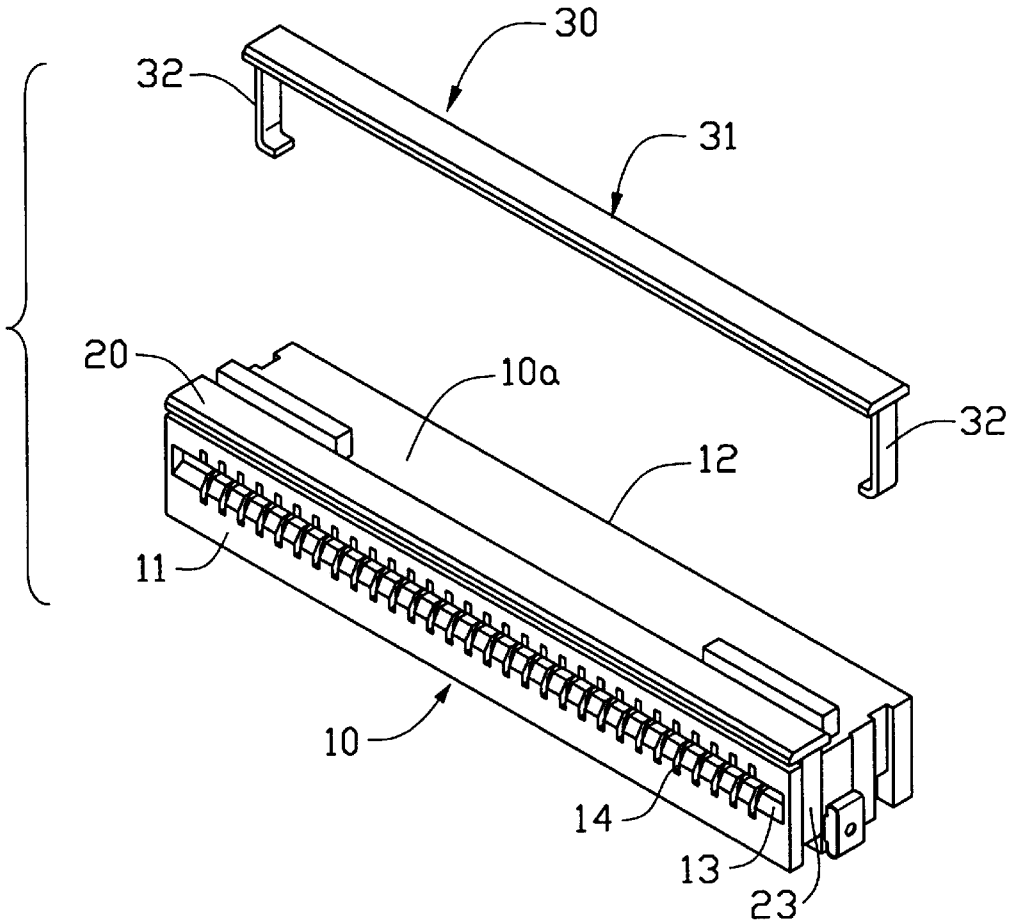
FIG. 2 is similar to FIG. 1 with an actuator assembled to a housing of the FFC connector.
Figure 4:
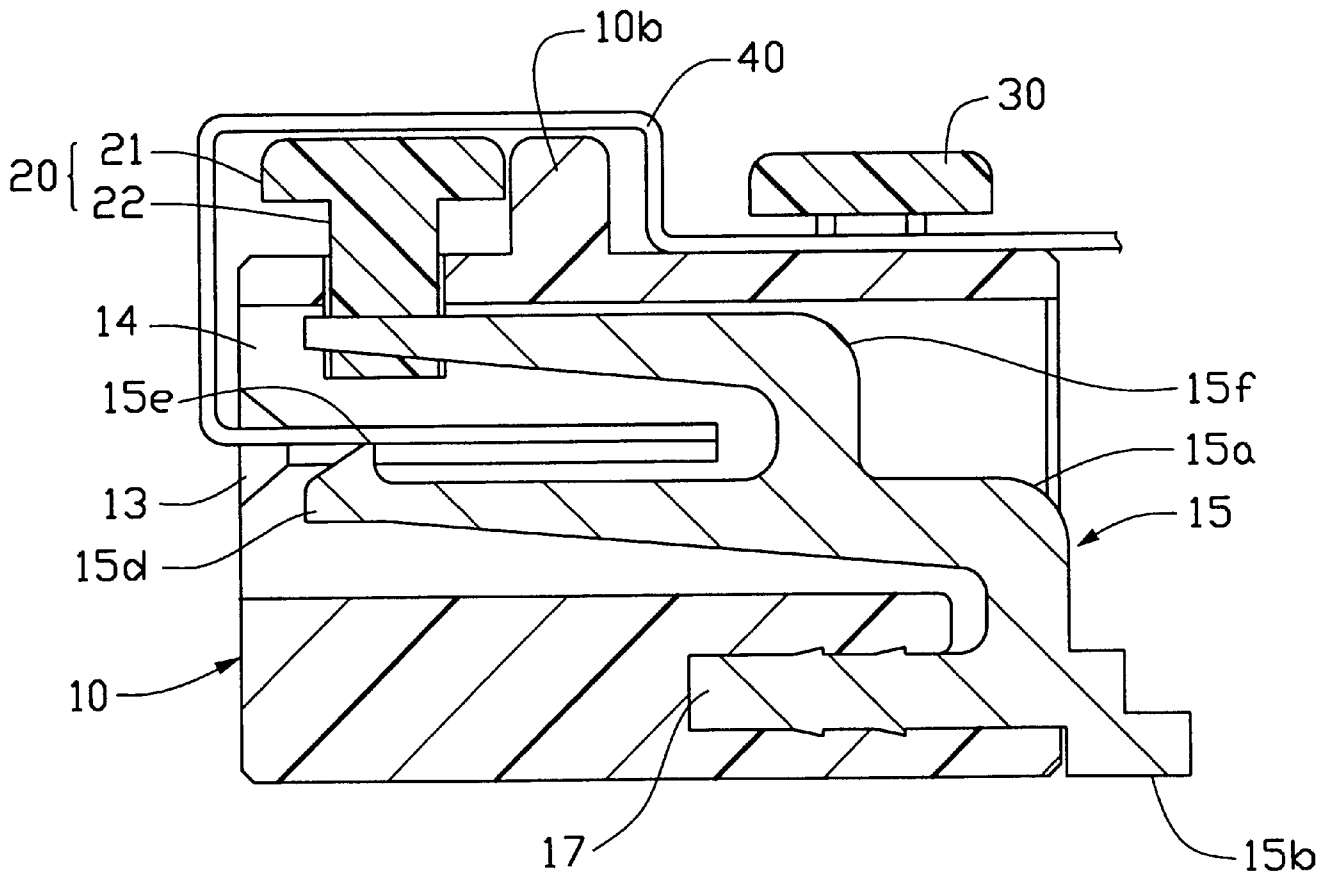
FIG. 4 is similar to FIG. 3 with a flat flexible cable, shown in phantom lines, assembled thereto.

Referring to FIGS. 1 and 2, an FFC connector 1 having a strain relief 30 in accordance with the present invention comprises an elongate dielectric housing 10 having a front face 11 and a rear face 12 opposite the front face 11. The housing 10 defines a lengthwise slot 13 for receiving a flat flexible cable 40 therein (FIG. 4). A plurality of passageways 14 are defined between the front and rear faces 11, 12. Each passageway 14 communicates with the elongate slot 13 and receives a terminal 15 therein for electrical connection with a conductor of the inserted flat flexible cable 40. The housing 10 defines a longitudinal groove 16 in a top face 10*a* of the housing 10 in communication with the passageways 14. An actuator 20 is movably assembled in the longitudinal groove 16 for abutting against portions of the terminals 15. The actuator 20 includes a base plate 21 having a rib 22 extending from a lower face thereof. The rib 22 extends into the longitudinal groove 16 for abutting against portions of the terminals 15. The actuator 20 includes a pair of hooks 23 on opposite ends thereof for assembling to the housing 10. The strain relief 30 is assembled to the housing 10 for attaching a wrapped portion of the flat flexible cable 40 to the housing 10 thereby reducing any motion between cable conductors of the flat flexible connector 40 and contacts of the terminal 15 (FIG. 4). The strain relief 30 includes a press bar 31 having a pair of hooks 32 on opposite ends thereof. In order to prevent the actuator 30 from being accidentally depressed, stoppers 10*b* are formed on the top face 10*a* of the housing 10.

Figure 3:
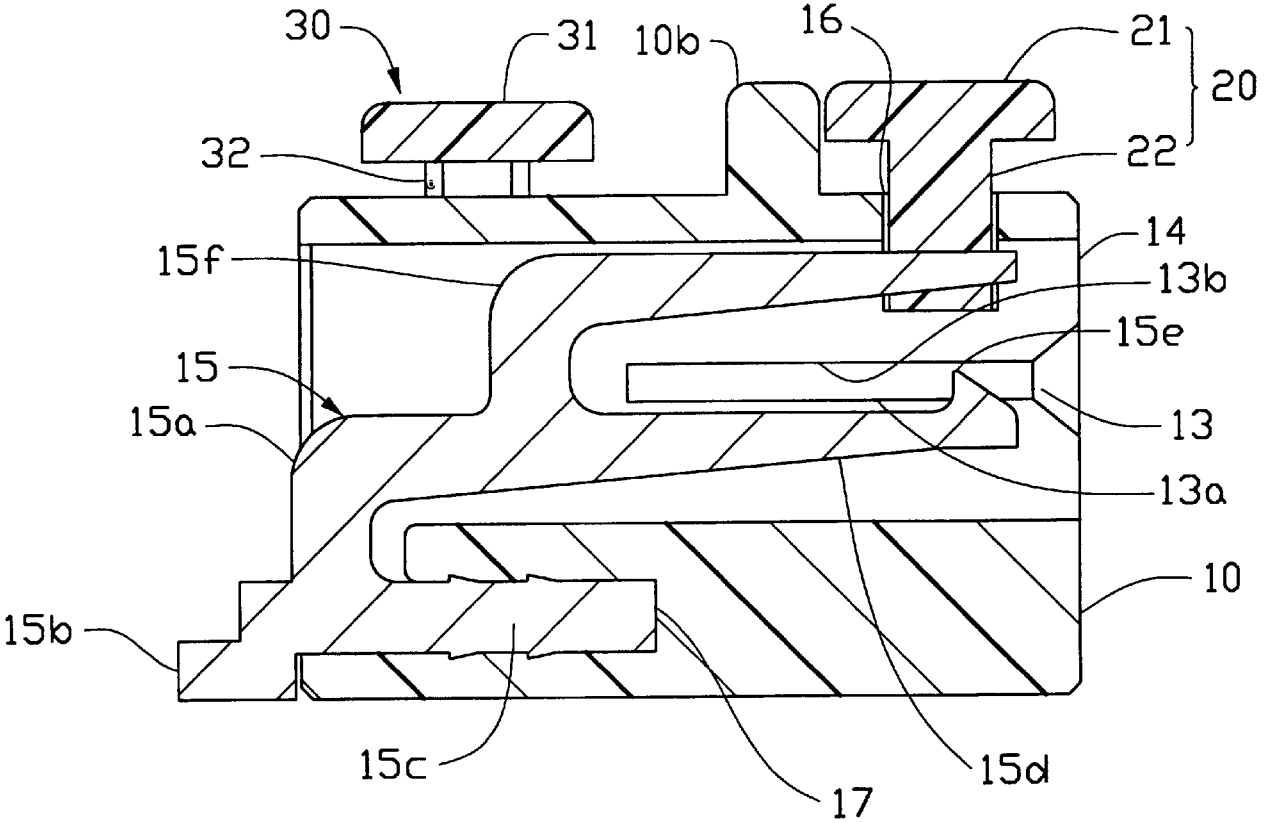
FIG. 3 is a cross sectional view of an assembled FCC connector.
Figure 5:
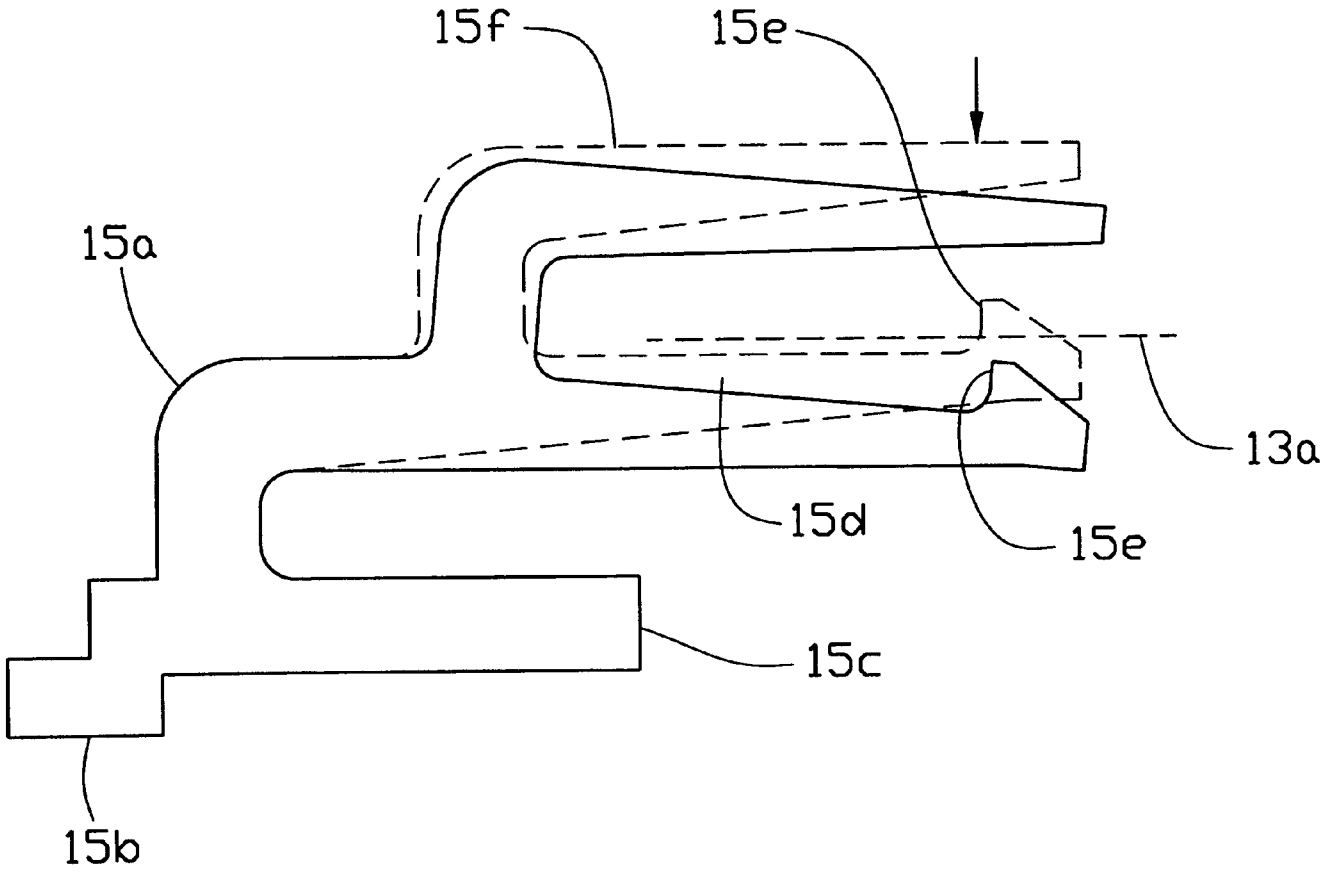
FIG. 5 is a schematic view of a terminal of the FFC connector showing displacement of biasing arm thereof.

Referring to FIG. 3, the terminal 15 includes a base portion 15*a* having a tail 15*b* for assembly to a printed circuit board (not shown). A mounting foot 15*c* extends from the base portion 15*a* for securely engaging with a mounting recess 17 of the housing 10. A first spring arm 15*d* extends from the base portion 15*a* and forms a contact 15*e* at an end thereof. An L-shaped biasing arm 15*f* extends from the spring arm 15*e* for abutting against the rib 22 of the actuator 20. By this arrangement, generally the actuator 20 is in an upper position by means of the rib 22 engaging with the corresponding terminals 15 and of the hooks 23 engaging with the housing 10. Differently, when the actuator 20 is depressed to a lower position, the rib 22 will push the biasing arm 15*f* downward whereby the contact 15*e* of the spring arm 15*d* moves below a lower face 13*a* of the elongate slot 13 (FIG. 5) thereby facilitating insertion of the flat flexible cable 40 therein. After the flat flexible cable 40 is seated, the depressing force is released and the biasing arm 15*f* and the associated spring arm 15*d* of resume their original positions thereby having the FFC sandwiched between the spring arms 15*d* of the terminals 15 and the upper face 13*b* in the slot 13 of the housing 10 for facilitating electrical connection between the contact 15*e* and the corresponding conductor of the flat flexible cable 40.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. An FFC connector having a strain relief, comprising:

an elongate dielectric housing having front and rear faces, said front face defining a lengthwise slot for receiving a flat flexible cable therein, said housing defining a plurality of passageways in communication with said slot, each passageway receiving a terminal therein for electrically connecting with an inserted flat flexible cable, said housing defines a longitudinal groove in a top face thereof, said longitudinal groove communicating with said passageways;

a strain relief assembled to said housing for attaching a portion of said flat flexible cable to said housing thereby limiting any motion between cable conductors of said flat flexible connector and terminal contacts, said strain relief including a lift bar having a pair of hooks on opposite ends thereof and which are engaged to said housing to assemble said lift bar thereto; and an actuator movably assembled to said housing, said actuator including a base plate having a rib extending downward from a lower face thereof and movably into said longitudinal groove for abutting against portions of said terminals when said actuator is assembled to said housing, said actuator including a pair of hooks on opposite ends thereof for engaging with said housing.

2. The FFC connector as recited in claim 1, wherein said terminal includes a base portion having a tail for assembly to a printed circuit board, a mounting foot extending from said base portion for securely engaging with a mounting recess of said housing, a first spring arm extending from said base portion, and an L-shaped biasing arm extending from said spring arm for abutting against said rib of said actuator.

3. An arrangement of actuating zero insertion of a conductor assembly with regard to a connector, comprising:

a housing of the connector with a plurality of terminals therein; and an actuator moveably positioned on the housing, said actuator including means for engagement with said terminals and means for latchable engagement with the housing; wherein said actuator can be retained in a first position, in which said conductor assembly can not be inserted into said housing, by respective engagement with the terminals and the housing, while can be depressed to a second position in a direction perpendicular to an insertion direction of said conductor assembly, in which said conductor assembly can be inserted into said housing, to move the terminals in said same direction for zero insertion of said conductor assembly with regard to the connector.

4. The arrangement as recited in claim 3, wherein said means for engagement with terminals is a rib extending through a groove in the housing.

5. The arrangement as recited in claim 3, wherein said means for engagement with the housing includes at least one hook.

6. A zero insertion force connector for use with a cable, comprising:

a housing defining a slot for receiving said cable therein, said slot defining a first face and an opposite second face thereof;

a plurality of terminals positioned within the housing, each of said terminals including at least a spring arm;

an actuator moveably assembled to the housing; wherein each of said terminal can be depressed by the actuator in a direction perpendicular to an insertion direction of said cable to have the corresponding spring arm moved along the same direction and retreated from the slot behind the first face of the housing for zero insertion of the cable while resumes back to have the cable sandwiched between the spring arm and the second face of the housing for electrical connection.

7. The connector as recited in claim 6, wherein each of said terminals further includes a biasing arm against which the actuator abuts.

* * * * *